US007866595B2

(12) United States Patent
Chadwick

(10) Patent No.: US 7,866,595 B2
(45) Date of Patent: Jan. 11, 2011

(54) PIVOTING PACKAGE SUPPORT

(75) Inventor: David Chadwick, Alpharetta, GA (US)

(73) Assignee: Automated Creel Systems, Inc., Alpharetta, GA (US)

( * ) Notice: Subject to any disclaimer, the term of this patent is extended or adjusted under 35 U.S.C. 154(b) by 189 days.

(21) Appl. No.: 11/867,251

(22) Filed: Oct. 4, 2007

(65) Prior Publication Data

US 2008/0173742 A1 Jul. 24, 2008

Related U.S. Application Data

(60) Provisional application No. 60/885,743, filed on Jan. 19, 2007.

(51) Int. Cl.
*B65H 49/38* (2006.01)
*B65H 49/04* (2006.01)
*D02H 1/00* (2006.01)

(52) U.S. Cl. ..... 242/591; 242/597.8; 242/131

(58) Field of Classification Search ..... 242/590, 242/591, 131, 131.1, 129.5, 129.7, 129.71, 242/134, 139, 141, 597, 597.8, 596.3, 129.72, 242/130–130.4, 592; 248/292.14, 222.51, 248/222.52, 224.8, 290.1, 289.31, 289.11; 211/96, 168, 170, 171

See application file for complete search history.

(56) References Cited

U.S. PATENT DOCUMENTS

| | | | | | |
|---|---|---|---|---|---|
| 339,684 | A * | 4/1886 | Patrick | 242/131.1 |
| 2,349,639 | A * | 5/1944 | Theiler | 242/131.1 |
| 4,829,611 | A * | 5/1989 | Fireman et al. | 5/47 |
| 4,880,184 | A * | 11/1989 | Crow | 242/130 |
| 6,345,783 | B1 * | 2/2002 | Worner | 242/594.6 |
| 7,434,774 | B1 * | 10/2008 | Floersch et al. | 248/183.2 |

* cited by examiner

*Primary Examiner*—William E Dondero
(74) *Attorney, Agent, or Firm*—Smith, Gambrell & Russell

(57) ABSTRACT

A yarn package manipulator permits an operator to mechanically grasp and manipulate packages or spools of stranded materials, such as yarn for loading and replenishing such materials in a manufacturing process. The package manipulator is suspended from a lifting device such as a cable hoist and has a control handle coupled to its frame for the operator to maneuver the device and carried materials. Selectively extensible fingers are pivotally attached to a pivot arm extending from the manipulator frame. The fingers are operable to grip the package by its core and pivots about a horizontal axis so that the spool of stranded material may be oriented for loading onto a creel or other station in a manufacturing process.

15 Claims, 8 Drawing Sheets

22
21
20
24
23
28
26
92
92
26
39
29
32
30
31
38
35
33
34
37
A

PIVOTING PACKAGE SUPPORT

CROSS-REFERENCE TO RELATED APPLICATIONS

This application claims the benefit of prior U.S. Provisional application Ser. No. 60/885,743, filed Jan. 19, 2007.

FIELD OF THE INVENTION

The present invention generally relates to creels used for supporting a plurality of packages or spools of stranded materials and automated loading of such spools on the creel. More particularly, the present invention relates to an automated creel loading system for use in the textile industry, wherein the stranded materials are yarns or other textile products. With even greater particularity, the invention relates to an automated handling apparatus and method for transferring a yarn package from a pallet or other material delivery platform to any one of a plurality of package support holders located on the creel. The invention further contemplates an improved package support holder for the creel.

BACKGROUND OF THE INVENTION

The use of creels for supporting a plurality of yarn packages is well known in the textile industry and has application in other stranded materials based industries. However, despite their widespread use, the task of loading a creel remains an extremely labor intensive operation involving both gross and fine motor skills. The nature of the loading tasks presents various risks to repetitive motion injuries such as carpal tunnel syndrome, spinal injuries, and other musculo-skeletal maladies. This is particularly the case in the manufacture of woven carpets, where the strength, durability, and weight of the yarns to manufacture such carpets typically requires yarn spools, known as packages, that have considerable weight in order to provide sufficient strand lengths to effectively feed modern high-speed processing systems.

Modern high-speed processing systems require a continuous, uninterrupted supply of yarns, fed from a plurality of yarn packages supported throughout the creel. The yarn package supports are arrayed on a plurality of support posts extending from the free standing frame of the creel, which is positioned to feed the manufacturing process. Eyelets or other guide means are provided throughout the creel through which each of a plurality of yarn strands are fed to the processing system. Usually a pair of package supports are configured in alignment with a single eyelet and the respective yarn strands from the paired packages are tied or otherwise attached in series to alternately feed the process. Due to the varying weights and strengths of a particular yarn package selected for a particular package support on the creel, as well as variations in the strand lengths of like yarn packages, the yarn will be depleted from the packages at irregular intervals. Consequently, laborers tasked to load and maintain the supply of yarns must constantly monitor the yarn packages and replace them at frequent intervals as the yarns are dispensed to feed the manufacturing process.

Replacement of a yarn package in a creel typically requires a worker to rotate a depleted package support out of the creel from its feed position to a loading position; remove and dispose of a spent cone from the package holder; lift the replacement yarn package from a delivery platform, such as a pallet; transport the package to the indicated package support; manipulate the package to mount it on the package support; rotate the replenished package support into the creel; and tie or otherwise secure the lead end of the replenished yarn package to the tail end of the paired feeding yarn package. A typical package will weigh on the order of 8 to 14 pounds.

In a given shift, a textile worker tasked to load and maintain the creel in a conventional process will lift, transport, and manipulate as much as six thousand pounds of yarn packages. Because the package supports are arrayed at varying heights and distances from the delivery platform, the typical laborer is subjected to significant risk of musculo-skeletal injuries presented at each step of the yarn package replacement process.

For example, in creels equipped with yarn package supports such as that disclosed in U.S. Pat. No. 4,880,184, rotation of the package support requires a two handed operation. First, the laborer must pull the locking handle with one hand in order to unlock the package support before it may be rotated from its use position. The laborer must then grasp the cone holder with the other hand to rotate the spent package cone to the loading position.

During lifting, transport and manipulation of a new cone, laborers will have a tendency to grasp the yarn package at the end of the package and either extend the fingers into the cylindrical cone and secure the outer diameter of the package with the thumb or vice versa, focusing the stresses in the hands, wrists, and forearms. In addition, the subsequent lifting, transport and manipulation of yarn package when grasped in this manner is particularly stressful on the musculo-skeletal tissues of the hand, wrist, and arm. Due to the dispersion of the package supports within the creel, frequent bending, lifting, and reaching is required to load the package, leading to shoulder, back and other musculo-skeletal stresses.

BRIEF SUMMARY OF THE INVENTION

Objects of the present invention are to provide various means for relieving musculo-skeletal stresses on the laborers tasked to load a creel. The invention alleviates many musculo-skeletal stresses by providing a package manipulator operatively attached to an overhead vertical hoist assembly in order to relieve the stresses of grasping, manipulating, transporting, and loading a package of stranded material, such as yarn, used to supply a manufacturing process.

The hoist assembly comprises a hoist frame supporting a longitudinal and lateral track system that permits a vertical hoist within the boundaries of a work station defined by the hoist frame and track system. A package manipulator assembly is suspended from the vertical hoist and performs the tasks of grasping, manipulating and transporting a package within the work station. Grips are provided on the manipulator for the laborer to ergonomically grasp and exercise gross and fine motor control over the movements of the suspended manipulator. Controls are provided on the manipulator assembly for activation of the vertical hoist, grasping a package, and rotating the package from a delivered position to a loading position. Preferably the controls are ergonomically positioned to permit the laborer to activate the controls while grasping the manipulator grip so that the laborer can quickly and efficiently complete loading tasks.

To facilitate loading, the present invention further contemplates an improved rotator package support assembly for loading packages to supply the manufacturing process. The rotator package support assembly of the present invention permits single-handed rotation of the package support arm and comprises a support arm extending outwardly from a collar, which is attached to a creel in pivotal relation to a rotator bearing. Rotator bearing comprises a rotator guide channel, that receives a guide pin extending inwardly from the collar. Guide channel has a locking portion, or first detent, that maintains the support arm in alignment within a material delivery point, such as an eyelet in a textile creel. An intermediate portion of the guide channel guides rotation of the support arm from the use position, defined by the first detent, to a loading position, defined by a second detent, or loading stop.

In addition to the advantages of relieving musculo-skeletal stresses on the package loader, the automatic creel loading system of the present invention provides efficiencies for the manufacturing process, particularly for the textile industry.

DETAILED DESCRIPTION OF THE INVENTION

Figure 1:
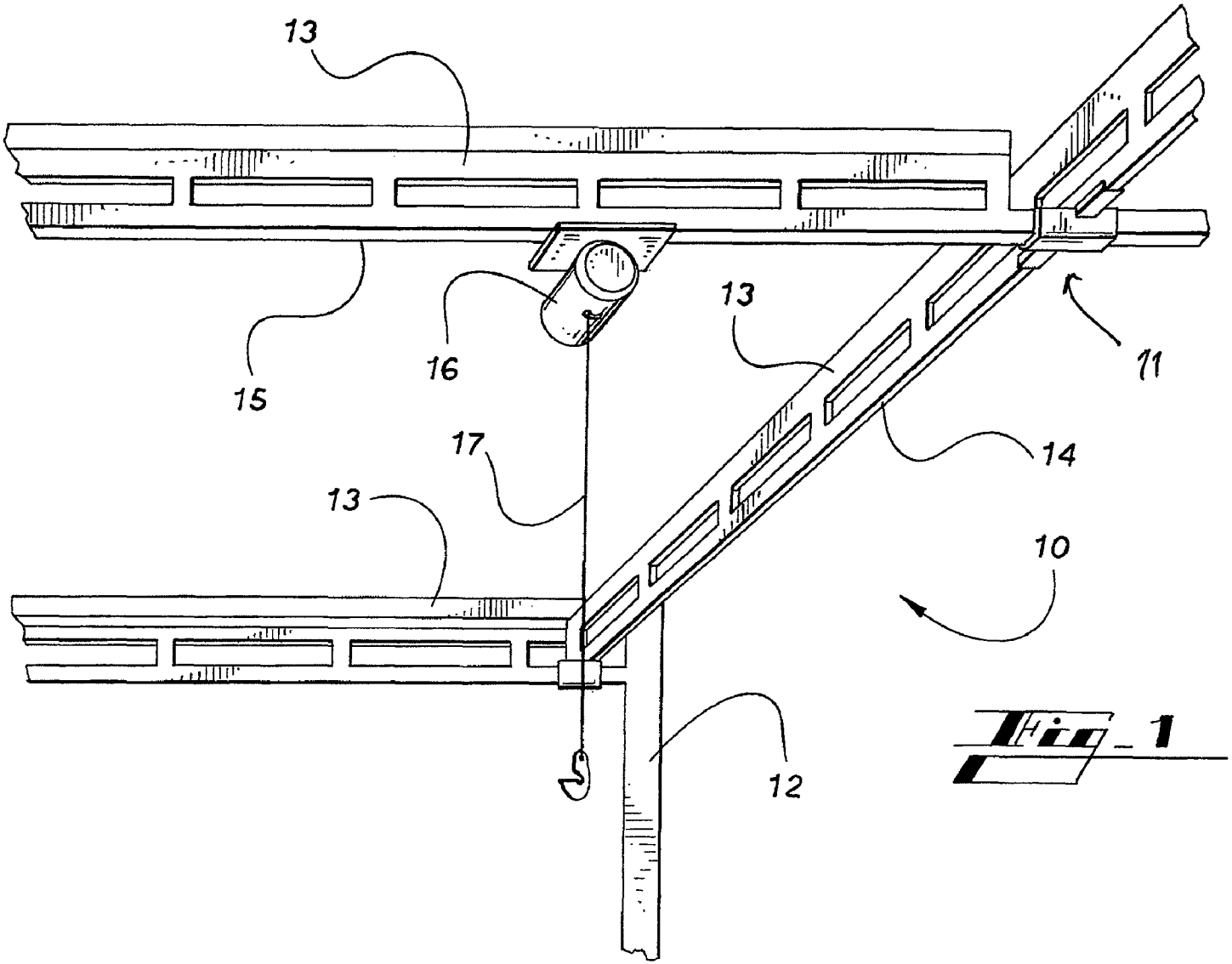
FIG. 1 is a perspective view of a hoist assembly.
Figure 4:
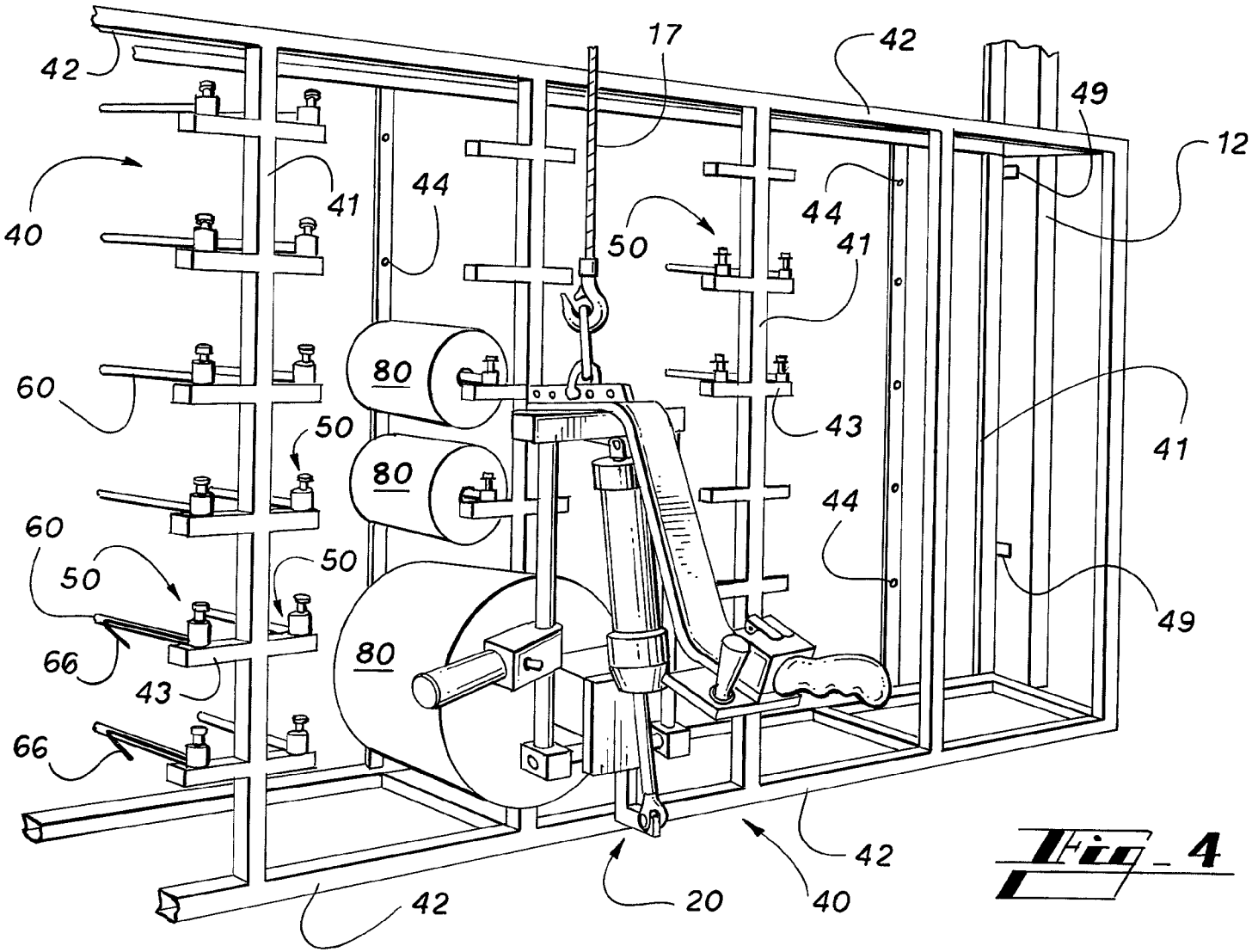
FIG. 4 is a front perspective view of a package loading station depicting a portion of the hoist frame, a creel, and package manipulator assembly.

Referring more particularly to the various drawings FIG. 1 depicts an illustrative automated creel loading system hoist assembly according to the present invention. As seen in FIG. 4, the system generally describes a material loading station, or work station for a manufacturing process, and comprises: a hoist assembly 10; a package manipulator 20 suspended on the hoist assembly 10; and a creel 40, supporting a plurality of packages 80 containing spools of material utilized in the manufacturing process. The workstation may also include a package delivery platform not shown for providing a supply of packages 80 to feed the manufacturing process. Inasmuch as the various aspects of the present invention are directed to supplying and replenishing a supply of stranded material to a manufacturing process requiring the same, the details of the manufacturing process are not particularly germane to the present disclosure, thus embodiments of the invention are applicable outside the textile industry.

As shown in reference to FIG. 1, hoist assembly 10 comprises a repositionable vertical hoist 16 suspended from a hoist frame 11. Hoist frame 11 is defined by a plurality of vertical supports 12 and a plurality of horizontal supports 13 interconnecting upper ends of the vertical supports 12. Supports 12 or 13 may be a stand alone system such as that depicted in the drawings. Alternatively, either or both of supports 12 or 13, may be provided by the structural supports of the manufacturing facility. In the stand alone embodiment depicted in the drawings, lower ends of the vertical supports 12 are affixed to a work surface of the manufacturing facility to secure the frame 11 in place. A longitudinal track 14 extends between vertical supports 12 permitting longitudinal translation of hoist 16 throughout the work station. A lateral track 15 extends between longitudinal tracks 14 to permit lateral translation of vertical hoist 16 throughout the work station. The cooperative translation of tracks 14 and 15, permit hoist 16 to be readily positioned anywhere within the work station, permitting a laborer to utilize the hoist 16 and manipulator 20 suspended from the hoist, to readily lift and move packages 80 without the substantial physical exertion required in conventional creel systems. As a consequence, a significant portion of the musculo-skeletal stresses encountered in conventional systems is substantially eliminated. An exemplary hoist assembly, that may be adapted for use in the contemplated invention is available from, Ingersoll Rand, Lode Rail, and Gorbel.

Figure 2:
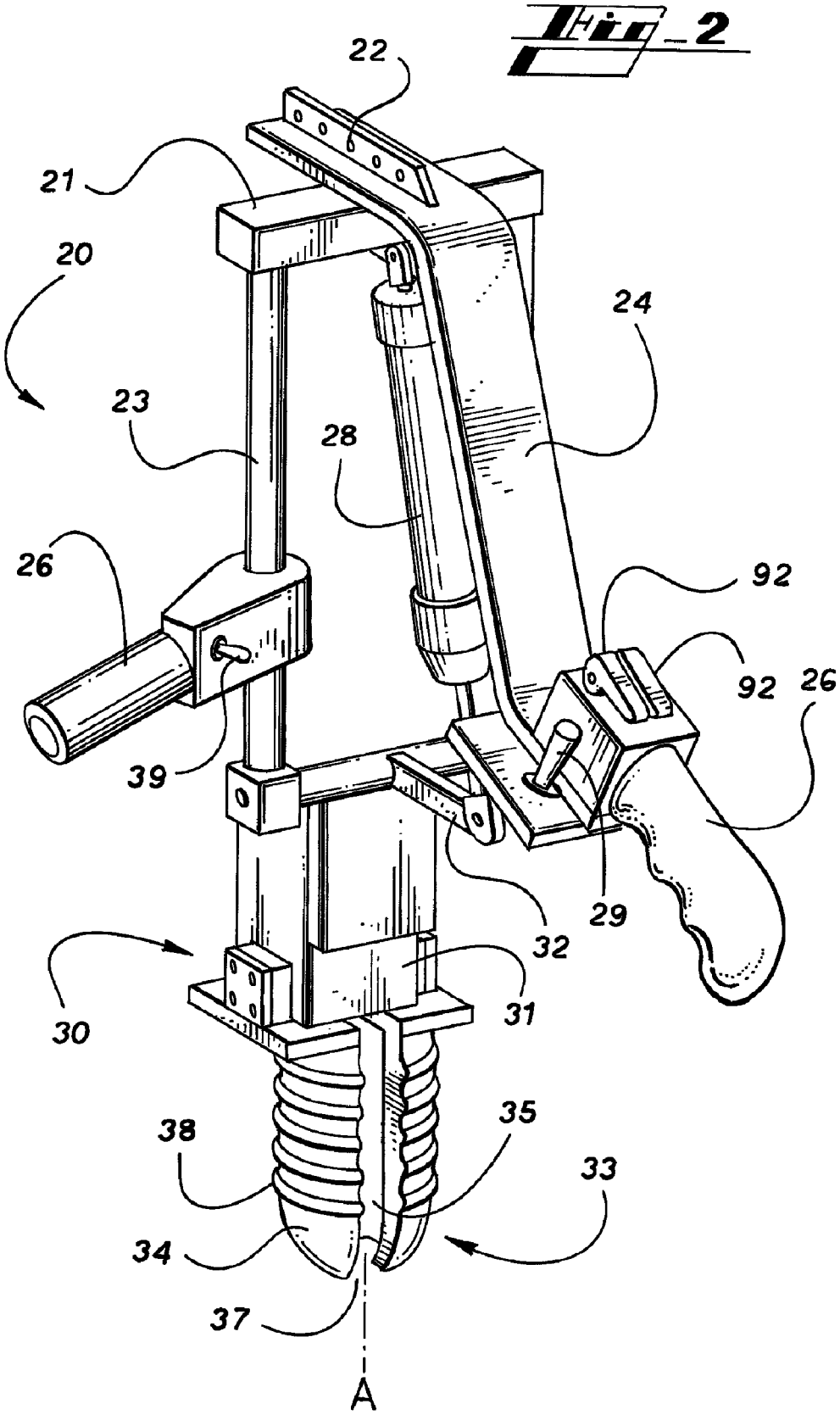
FIG. 2 is a perspective view of a manipulator assembly.
Figure 3:
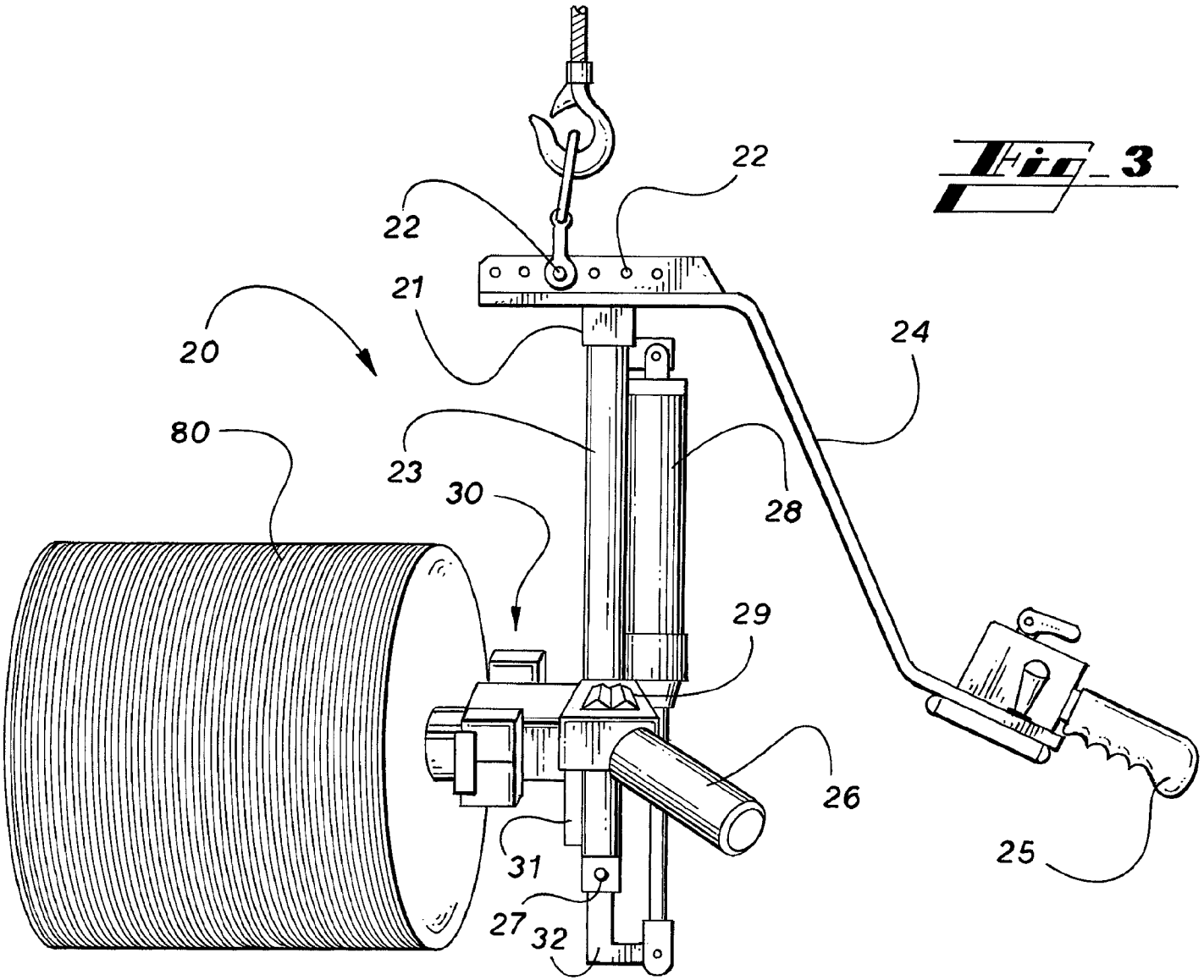
FIG. 3 is a side elevational view of a manipulator assembly.

To further reduce the stresses encountered by package loading laborers, the package manipulator 20 is provided and is adapted to perform the task of grasping and rotating a package 80 from a vertical orientation, as defined by the central axis of the package spool, or cone 82. As is best seen in reference to FIGS. 2 and 3, package manipulator 20 comprises a manipulator frame 21, a finger assembly 30 for grasping, holding, and manipulating a material package 80, and controls 29, 39, 92, for the same. Manipulator frame 21 has a downwardly extending pivot arm 23, or fork, joined to a first end of a control arm 24 that extends at an angle downwardly and outwardly from the junction between pivot arm 23 and control arm 24. One or more attachment points 22 are defined in frame 21 for attachment of a lifting cable 17. Vertical controls 92 provided on manipulator 20 are operable by the laborer to selectively control the extension or retraction of lifting cable 17 from hoist 16.

Attachment points 22 are selected to permit balancing of the manipulator 20 to varying weights of material carried on package 80. A control handle 25 is provided at a second end of control arm 24 and provides a suitable gripping point for the operator to grasp and maneuver the manipulator 20, and is more preferable disposed at an ergonomic angled with respect the manipulator 20 so as to avoid the imposition of undue musculo-skeletal stresses. A guide handle 26 extends outwardly from a lower end of pivot arm 23 to provide the operator a second point for grasping and maneuvering the manipulator 20 and package 80. Preferably guide handle 26 is disposed at an ergonomic angle with respect to the manipulator frame 21, so as to avoid musculo-skeletal stresses. A second guide handle 26 may be provided at an opposite side of the frame 21, to accommodate the dexterity of a particular laborer. A second guide handle 26 may also be advantageous in providing a given laborer the ability to alternate his or her control of the manipulator 20 between limbs, so as to avoid introducing a new repetitive impact hazard.

As previously discussed, a primary source of musculo-skeletal stress injuries for package loaders involves the laborer's grasping and manipulation of the packages 80, while completing the requisite package loading tasks. A significant object of the present invention, therefore involves elimination of this risk. In this regard, manipulator 20 is intended to substitute the laborer's need to manually grasp and manipulate the package 80. In order to grasp a spool or package 80 of materials, manipulator 20 includes a gripping assembly 30 which comprises a plurality of projections, or fingers 33, disposed about central axis A. Fingers 33 are selectively extensible about axis A between a closed, release position, and an open gripping position. In the open gripping position the outer surface 34 of fingers 33 engage an inner surface of cylindrical core, or cone 82 of the package 80. Preferably, fingers 33 have a curved outer surface 34 having a radius of curvature R substantially the same as an inner radius R' of a cylindrical core 82 of the package 80, to be grasped and carried by the manipulator 20.

Because the packages 80 are intended to be placed and supported on a support arm 60, the inner surface 35 of fingers 33 will define a void along axis A, which is capable of receiving support arm 60. As will be appreciated by those in the textile industry, support arm 60, may also include a cone holder 66, that will extend outwardly from support arm as shown in FIG. 4 and resiliently engage the inner surface of the package cone. Accordingly, a gap 37 should be defined between adjacent fingers 33 so as to avoid interference or contact with cone holder 66 while loading package 80 onto support arm 60. To improve the grip of fingers 33 with the inner surface of cone, the finger's outer surface 34 may be provided raised protrusions 38 such as the ribs 38 shown in the various drawings.

In the typical textile manufacturing process, replenishment packages 80 are stacked and delivered to the work station with their cylindrical cores aligned vertically. Because the support arms 60 are horizontally disposed, the replenishment packages 80 must be rotated from their delivered vertical disposition to the substantially horizontal alignment necessary to load the package 80 into the creel. Accordingly, the manipulator's gripping assembly 21 is pivotally disposed in manipulator frame 30 at a pivot point 27, and operable between a package retrieval position and a package loading position by a pivot actuator 28. Activation of pivot actuator 28 rotates gripping assembly 30 about pivot point 27 such that fingers 33 are substantially horizontally disposed. In the package retrieval position, gripping assembly 30 is oriented such that fingers 33 project downwardly. As may be seen in reference to FIG. 2, fingers 33 preferably have rounded tips to facilitate their alignment with and insertion into cone 83.

Pivot actuator 28 is operatively attached between manipulator frame 21 and a fulcrum acting through the pivot point 27 on gripping assembly 30, such as the pivot lever 32 shown in the drawings. A pivot control 29, permits the laborer to control rotation of pivot actuator 28. Preferably, pivot control 29 is operable by the laborer while the laborer grips either control handle 25 or guide handle 26 which permits the laborer to maintain control of the manipulator 20, while maneuvering the carried package 80 for loading on creel a creel package support 60.

Figure 11:
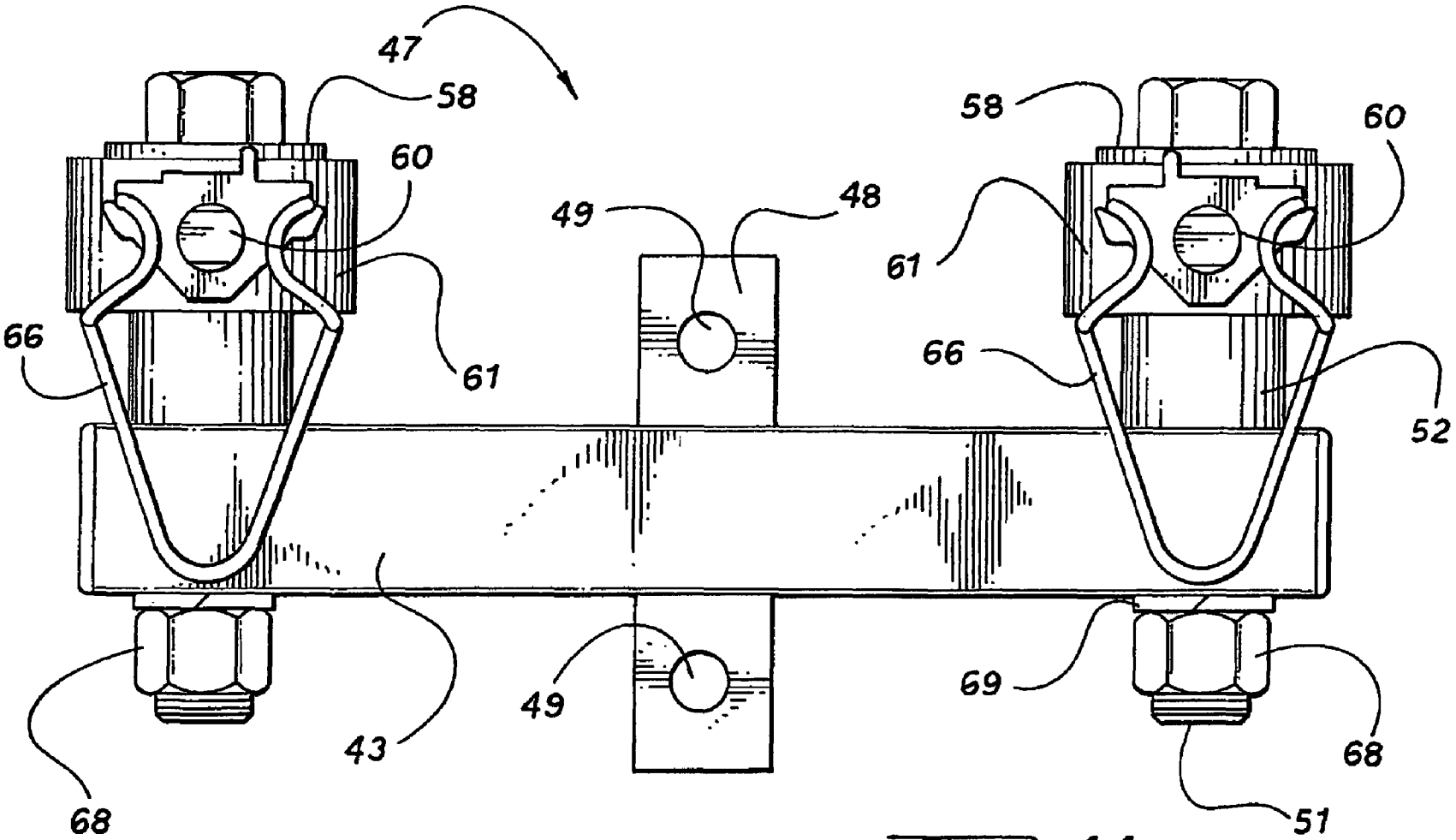
FIG. 11 is a stub adapter assembly and rotator package support.

To facilitate loading of packages 80 on creel 40, the present invention further contemplates the provision of an improved package support 50 that permits one-handed rotation of support arm 60 and package 80 carried thereon. As may be seen in reference to FIGS. 5-9 and familiar to those of skill in the art, creel 40 comprises a plurality of vertical frame members 41 interconnected by a plurality of lateral frame support members 42. As with the prior art creel supports, the rotator package support assembly 50 of the present invention may be attached to support stubs 43 laterally extending from frame members 41 or 42. For creels 40 that are not configured with stubs 43, such creels may be retrofitted with a stub adapter 47, such as that depicted in FIG. 11. Stub adapter 47 comprises a horizontally disposed bar having at least one stub 43 and an adapter bracket 48 that may be affixed to frame support members 41, 42. In the exemplary embodiment shown, adapter bracket 48 is vertically disposed at a midpoint between two stubs 43, and has a pair of mounting holes 49, for receiving fasteners, such as pins, bolts, screws to secure the stub adapter to frame support members 41, 42.

The rotator package support assembly 50 of the present invention comprises a mounting post, or bolt 51 for attaching support assembly 50 to a support stub 43; a rotator bearing 52; a support arm 60; and a collar 61. As is best seen in reference to FIGS. 5 and 7, rotator bearing 52 comprises a rotator guide channel 54 defined in an outer surface of bearing, and an inner bore 53 defined through an axial length of bearing 52. Inner bore 53 is dimensioned to receive mounting post 51 through inner bore 53. Guide channel 54 comprises a first stop portion 56, corresponding to a use position in which support arm 60 is selectively maintained in position in alignment with eyelet 44 as shown in FIG. 4, an intermediate portion 55 defining an arc through which support arm 60 may be rotated, and a second detent or loading stop portion 57, corresponding to a loading position at which support arm 60 is temporarily positioned to facilitate replenishment of the yarn package 80.

Collar 61 defines an axial collar bore 62, a support arm 60 extends radially outwardly from a collar aperture 64, and a rotator guide pin 63 extends from an inner surface 65 of collar 61 into collar bore 61. Collar bore 62 is dimensioned such that it pivotally receives bearing 53 therein. In the exemplary embodiment depicted, support arm 60 is threadingly received through aperture 64 such that a first end of support arm 60 also serves as the rotator guide pin 63. Support arm 60 may retained in aperture 64 with a lock nut 67 or other securing means. As will be appreciated by those of skill in the art, support arm 60 may also include a cone holder 66 suited to a particular yarn package 80. Cone holder 66 may be attached to collar 61 or a cone holder retainer 68 may be provided on support arm 60, in which case cone holder retainer may be substituted for lock nut 67. Alternatively, support arm 60 may be press fit or welded to collar 61.

For ease of assembly, at least one stop 56, 57, preferably loading stop portion 57 of guide channel 54, extends through the upper end of bearing 52. By this arrangement, assembly of rotator package support assembly 50 is readily accomplished by placing a retainer 58, such as a washer, over bolt 51 and then inserting bolt 51 through collar 61, which is preferably pre-assembled with the first end of support arm 60 extending through collar 61 to serve as guide pin 63, as described in the preceding paragraph. Bolt 51 may then be inserted through bearing bore 53 and bearing 52 rotated such that guide pin 63 aligns with the opening of loading stop portion 57 extending through the upper end of bearing 52. The assembled rotator package support 50 may then attached to stub 43 by inserting post or bolt 51 through a mounting hole 46 defined in stub 43, and then secured to stub 43 by a fastener, such as a nut 68 and lock washer 69, or any other suitable means. Before tightening the assembly, support arm 60 should be rotated on bearing 52 until guide pin 63 is received in guide channel first stop portion 56. Support arm 60 and bearing 52 should then be aligned with its associated creel eyelet 44. Once aligned, nut 68 is tightened such that bearing 52 is secured in its proper orientation between retainer 58 and stub 43.

Inasmuch as the alignment of support arms 60 with its associated creel eyelet 44 can be predetermined based on the geometry of guide channel 54 and the disposition of stub 53, a preferred embodiment of the invention contemplates that bearing 52 further comprises an alignment slot 59, or bore 59, defined in the lower end face of bearing 52. Stub 43 is also modified to include a cooperating alignment pin 44 defined on the surface of the stub 43 subjacent the bearing 52. By this arrangement, the rotator package support assembly 50 can be automatically aligned with eyelet by the engagement of alignment pin 44 within alignment slot or bore 59, and the assembly may then be securely tightened to stub 43 without need of further alignment.

Figure 5:
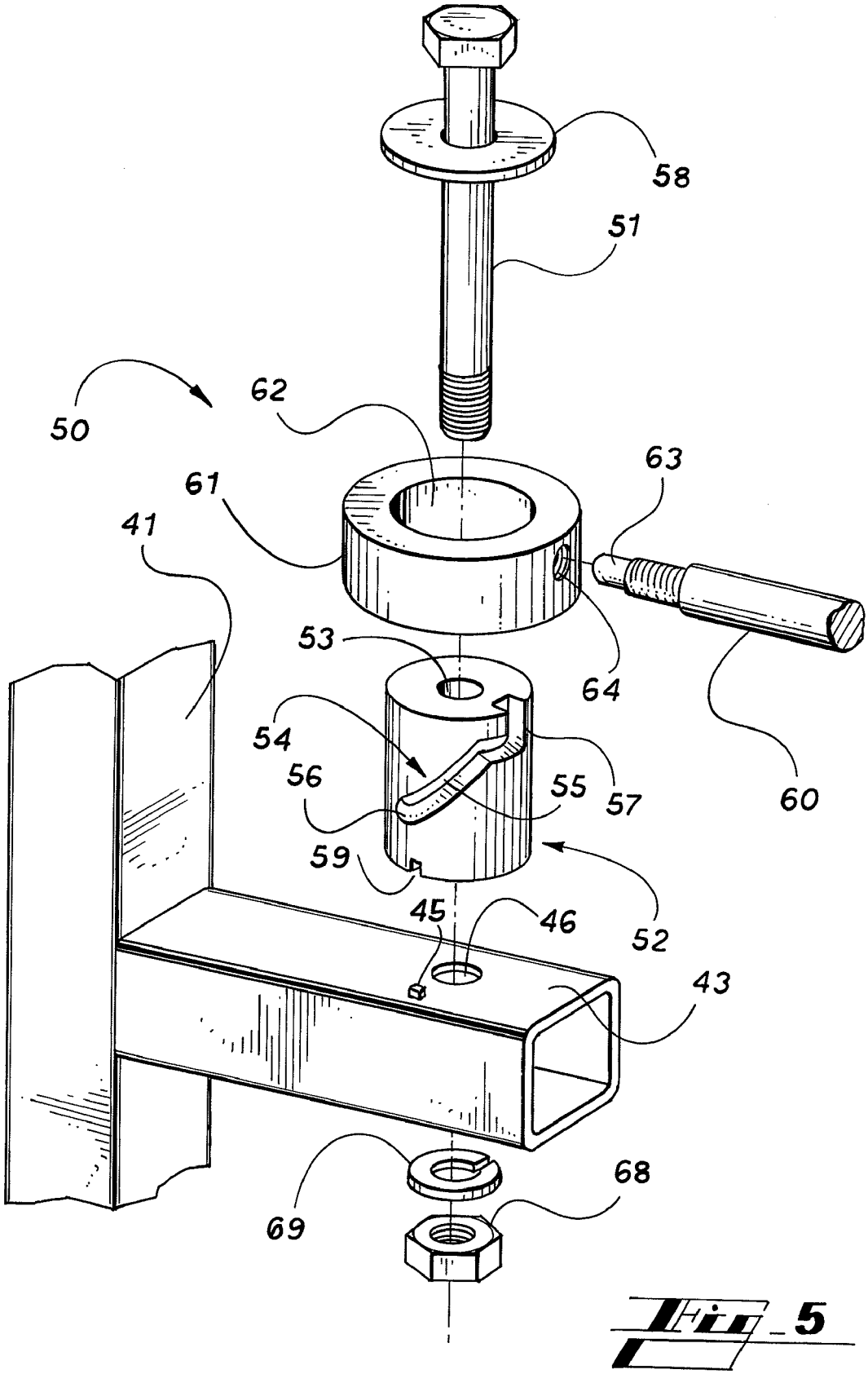
FIG. 5 is an exploded view of a rotator package support assembly and mounting stub.
Figure 6:
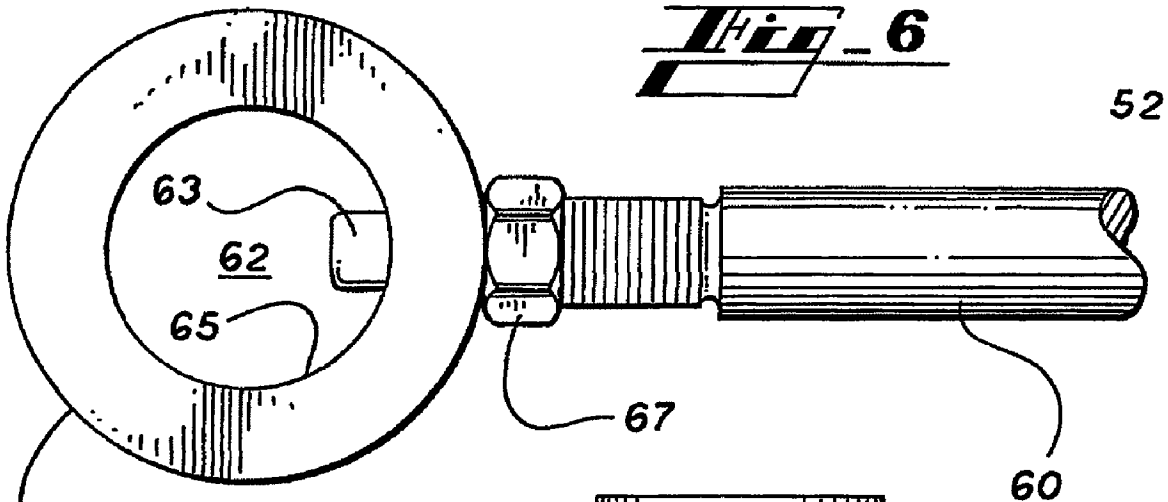
FIG. 6 is an overhead plan view of a collar and support arm.
Figure 7:
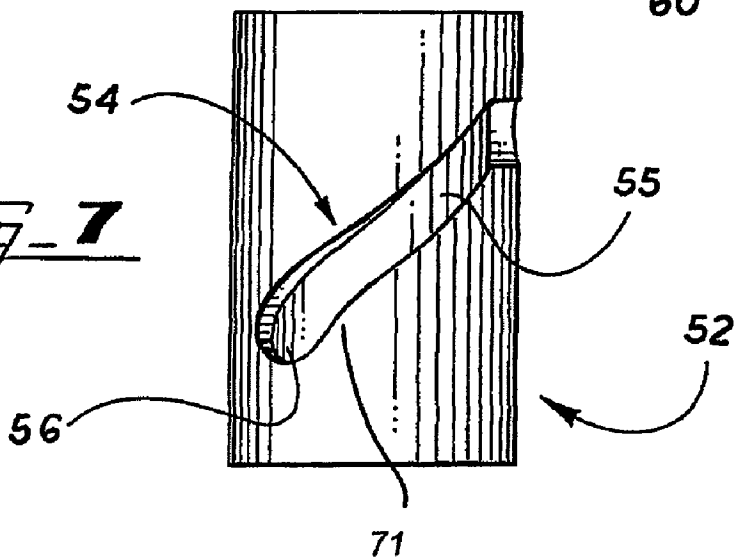
FIG. 7 is a detailed view of a rotator bearing depicting a preferred junction of intermediate guide channel portion and guide channel locking portion.
Figure 8:
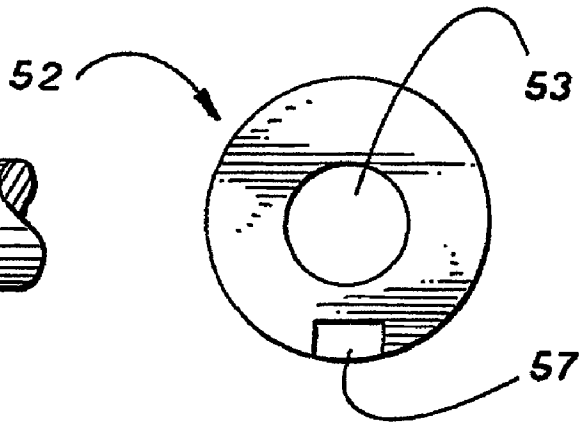
FIG. 8 is an top end view of a rotator bearing and guide channel loading portion.
Figure 9:
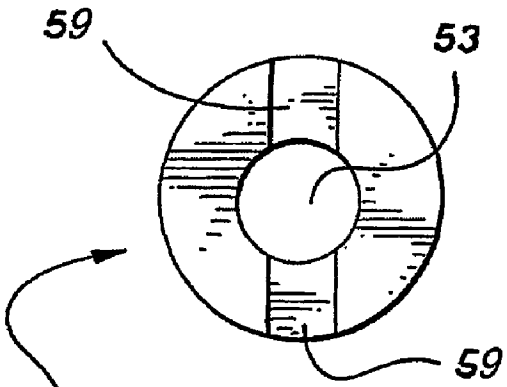
FIG. 9 is a bottom end view of a rotator bearing and an alignment slot.
Figure 10:
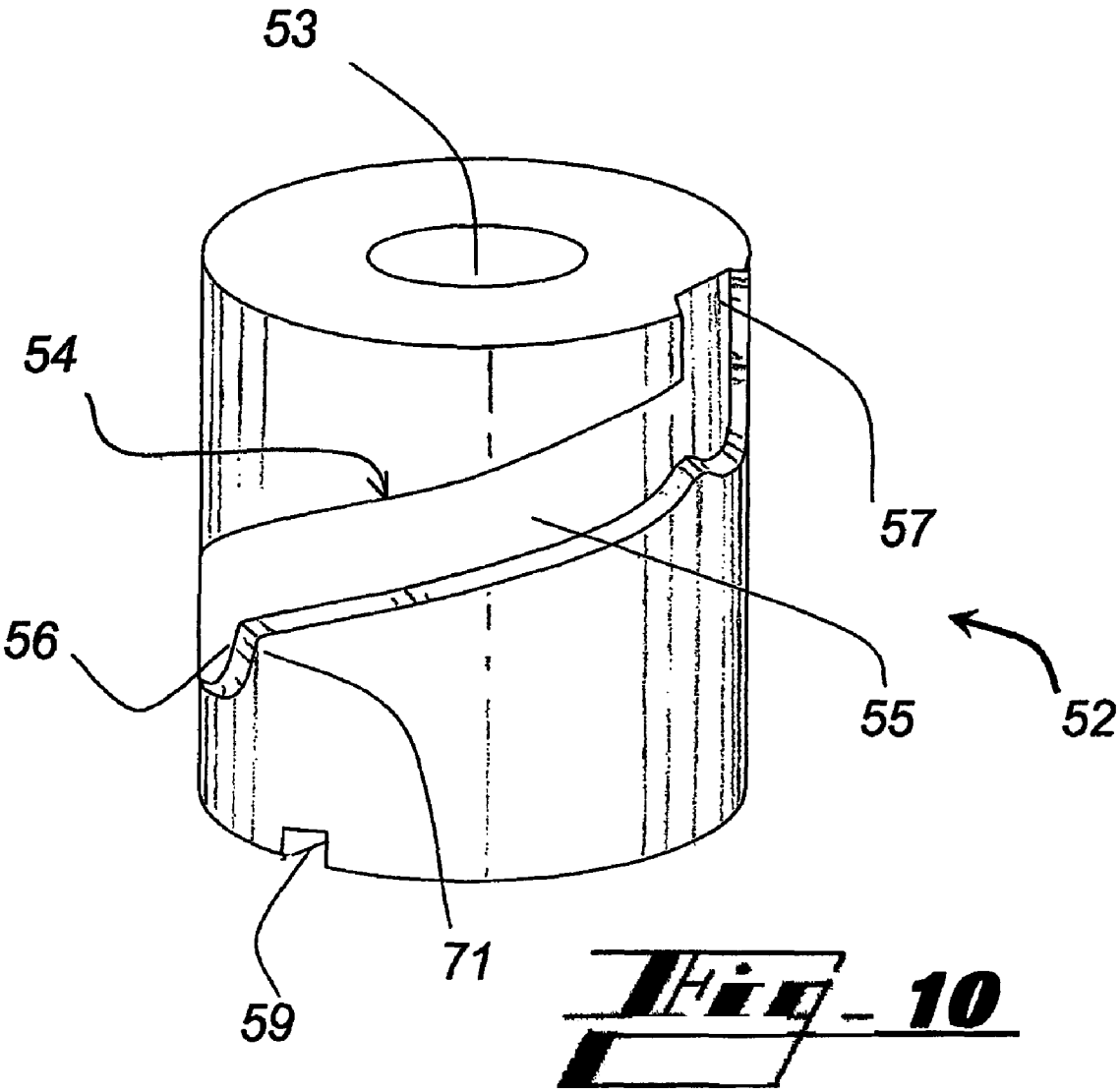
FIG. 10 is an alternative embodiment of a rotator bearing guide channel.

In preferred embodiments such as those shown in reference to FIGS. 5, 7 and 10 the intermediate portion 55 of guide channel 54 is defined having an upwardly sloping spiral groove 55. The upward slope of intermediate portion 55 facilitates rotation of support arm 60 into the use position and also serves to maintain support arm 60 in alignment with eyelet 44. Furthermore, in the event the support arm 60 should jump out of first stop 56 due to a yarn snag or breakage, the slope will facilitate automatic realignment and reseating of support arm 60 within first locking portion 56 due to gravity. As will be readily appreciated, the preferred spiraled guide channel 54 will have clockwise or counterclockwise rotation depending upon the orientation of package support assembly 50 within creel 40.

In this preferred embodiment, I have also found that it is desirable for locking portion 56 to be defined with a slope greater than or equal to that of the spiral portion 55 and having a vertical depth sufficient to receive a portion of guide pin 63 in a detent relation, as best seen in reference to FIG. 10. This arrangement facilitates retention of support arm 60 and collar 61, within locking portion 56 when package 80, carried by support arm 60 and collar 61, is rotated into the use position and guide pin 63 positively seats within locking portion 56. The resultant cam surface 71, defined at the junction of intermediate portion 55 and locking portion 56 permits support arm 60 to be readily rotated to its loading position with minimal vertical lifting to overcome the detent engagement of guide pin 63 within locking portion 56, and rotating support arm 60 to the loading position. I have also found that the advantage of single-handed, stress relieving operation of the rotator support package 50 is lost when the slope or depth of locking portion exceeds critical values, such that excessive vertical forces must be applied to overcome the detent. It should be noted that in many applications cam surface 71 may not be necessary to retain package 80 in the use position. Accordingly, first loading stop 56 may be defined by the lower end of the spiral groove of intermediate portion 55, such as depicted in FIG. 7.

An added advantage we have discovered in connection with providing a hoist frame 11 to the creel loading work station of the present invention is that we were able to stabilize the creel 40. Normally, creel 40 is a free standing framework that is secured to the floor of the work station. Due to the height and loading of the creel, the framework may become unstable such that it will sway from side to side. Hoist frame 11 is defined to provide access to the full length and height of the creel 40 with manipulator 20. As may be seen in the right hand portion of FIG. 4, positioning the vertical supports 12 of hoist frame 11 at the ends of creel 40, hoist frame 11 provides a ready means for stabilizing the creel 40 by attachment 49 to the frame's vertical supports 12.

While the system thus far described has discussed the various aspects of the invention provided to relieve musculo-skeletal stresses at a package loading station having a single creel 40, the advantages provided by these the hoist assembly 10 and package manipulator 20, also facilitate expansion of the package loading work station to service multiple creels with the same equipment. As will be appreciated additional creels may be effectively serviced from any of the four sides of the work station as defined by the hoist frame assembly 11, since the manipulator 20 is readily translated to any point within the enclosure. Similarly, the efficiency of the package loading work station, as described herein, may be further improved by providing an improved package delivery platform, such that packages 80 are provided at the work station elevated from the floor so as to avoid the need for the package loaders to bend over in order to grasp a package 80 with manipulator 20. Alternatively, delivery platform may include as a conveyor so elevated.

While the improvements described herein will provide substantial relief for the potential for musculo-skeletal injuries, they also offer significant manufacturing advantages. For example, with the system herein described, the weight of the yarn packages 80 may be substantially increased from their current 8 to 14 pounds. With the system contemplated, yarn package 80 weights of approximately 50 pounds will be readily maintainable. The increased weights will provide yarn lengths of approximately 2.5 times that of conventional yarn packages. In as much as the knots joining yarn packages can become a significant source of process failures, the elimination of this source of error and disruption presents a significant improvement to the manufacturing process.

From the above description of the various aspects of the invention, those skilled in the art will perceive improvements, changes and modifications within the skill of the art from those herein described. Application in a wide variety of manufacturing process as well as various changes and modifications from the described embodiments may be made without departing from the spirit and scope of the invention, as defined by the appended claims.

I claim:

1. A rotator package support for attachment to a creel frame comprising: a substantially vertical mounting post having an elongate shaft; a rotator bearing having an inner bore dimensioned to receive said mounting post through said bore and a guide channel defined in an outer surface of said rotator bearing, said guide channel including a first stop portion, an intermediate portion, and a second stop portion; a collar having a collar bore extending through said collar, wherein said rotator bearing is pivotally received in said collar bore, a rod threadedly received in a radial aperture in said collar defining a guide pin protruding from an inner surface of said collar into said collar bore and slidingly received in said guide channel and a support arm extending radially outwardly from said collar to a free end resiliently engageable within an inner cavity of a package cone, wherein said guide channel second stop portion extends through an end of said rotator bearing.

2. The rotator package support of claim 1, wherein said support arm further comprises a cone holder.

3. The rotator package support of claim 1, wherein said guide channel intermediate portion comprises a spiraled groove.

4. The rotator package support of claim 3, wherein said guide channel first stop portion further comprises a detent extending downwardly from said intermediate portion and dimensioned to seat at least a portion of said guide pin in said detent.

5. The rotator package support of claim 4, wherein said guide channel further comprises a cam surface defined between said detent and said intermediate portion.

6. The rotator package support of claim 1, wherein said support arm is rotatable between a use position and a loading position, and in said use position said guide pin is in abutment with said first stop portion.

7. The rotator package support of claim 6, wherein in said loading position said guide pin is positioned in abutment with said second stop portion.

8. A package support apparatus comprising: a support arm attached to a collar, said support arm having a first end extending within an axial bore of said collar to form a guide pin and a free end extending outwardly horizontally from said collar and adapted to support a spool of stranded material; said collar supported on a rotator bearing pivotally received in said collar bore, said rotator bearing defining a guide channel in an outer surface of said rotator bearing, said guide channel having a first stop portion, an intermediate portion, and a second stop portion; wherein said guide channel is adapted to receive said guide pin in sliding relation within said guide channel such that upon rotation of said collar in a first direction about said rotator bearing, contact of said guide pin with said first stop portion aligns said support arm in a use position, and upon rotation of said collar in an opposite direction about said rotator bearing, contact of said guide pin with said second stop portion aligns said support arm in a loading position, wherein said guide channel extends through an end of said rotator bearing, such that said guide pin can be received in said guide channel from said end of said rotator bearing.

9. The package support apparatus of claim 8, wherein said guide channel is a spiraled groove that slopes upwardly from said first stop to said second stop portion.

10. The package support apparatus of claim 8, wherein said first stop further comprises a detent.

11. A package support apparatus for pivotally supporting a spool of stranded material on a creel comprising: a support arm extending through a collar to a free end on which said spool is carried; said collar pivotally supported on a rotator bearing attached to said creel; said rotator bearing having a guide channel defined in an outer surface of said rotator bearing, said guide channel having a first stop and a second stop at opposite ends of said guide channel; said support arm extending inwardly of said collar to form a guide pin cammingly engaged with said guide channel such that upon rotation of said collar in a first direction, guide pin contact with said first stop aligns said support arm in a use position and upon rotation of said collar in an opposite direction, guide pin contact with said second stop aligns said support arm in a loading position, wherein said guide channel extends through an upper end of said rotator bearing.

12. The package support apparatus of claim 11, wherein said guide channel is a spiral groove.

13. The package support apparatus of claim 11, wherein said first stop comprises a detent into which said guide pin is at least partially seated in said detent.

14. A package support adapter assembly for a creel having a frame support member comprising: a rigid bar having at least one transverse stub; an adapter bracket affixed to said rigid bar and releasably attached to said frame support member, a support arm extending through a collar and having a free end for engaging said package; said collar pivotally supported on a rotator bearing attached to said at least one stub; said rotator bearing having a guide channel defined in an outer surface of said bearing, said guide channel having a first stop and a second stop at opposite ends of said guide channel, said guide channel extending through an end of said rotator bearing; said support arm having a second end forming a guide pin extending within said collar and slidably engaged with said guide channel such that upon rotation of said collar in a first direction, guide pin contact with said first stop aligns said support arm in a use position and upon rotation of said collar in an opposite direction, guide pin contact with said second stop aligns said support arm in a loading position.

15. A package support for a creel having frame for supporting a plurality of packaged strand material on hollow cores comprising:

at least one stub extending generally horizontally from said frame, at least one vertical shaft detachably mounted to and extending upwardly from said stub;

at least one rotator bearing circumscribing said vertical shaft and captured thereon between an upper end of said shaft and said stub, said rotator bearing having an inclined guide channel defined in the vertical surface thereof and extending through an end of said at least one rotator bearing;

a collar rotably mounted on said rotary bearing concentric with said vertical shaft and constrained to move about said rotator bearing in accordance with said guide channel;

and a support arm mounted to said collar and extending therethrough with a first end of said support arm forming a guide pin engaged in said guide channel and a free end of said support arm adapted to resiliently engage the inside surface of a core.

* * * * *